US005631684A

United States Patent [19]

Takaide et al.

[11] Patent Number: 5,631,684

[45] Date of Patent: May 20, 1997

[54] INK JET TEXTILE PRINTING SYSTEM AND METHOD USING DISPERSE DYES

[75] Inventors: Aya Takaide, Yokohama; Masahiro Haruta, Tokyo; Shoji Koike, Yokohama; Koromo Shirota, Inagi; Tomoya Yamamoto; Mariko Suzuki, both of Kawasaki, all of Japan

[73] Assignee: Canon Kabushiki Kaisha, Tokyo, Japan

[21] Appl. No.: 265,271

[22] Filed: Jul. 1, 1994

[30] Foreign Application Priority Data

Jul. 9, 1993 [JP] Japan ..... 5-170474

[51] Int. Cl.[6] ..... B41J 2/21

[52] U.S. Cl. ..... 347/100; 347/106; 347/102

[58] Field of Search ..... 347/100, 106, 347/101, 102

[56] References Cited

U.S. PATENT DOCUMENTS

| | | | |
|---|---|---|---|
| 4,702,742 | 10/1987 | Iwata et al. | 347/106 |
| 4,725,849 | 2/1988 | Koike et al. | 347/106 |
| 5,250,121 | 10/1993 | Yamamoto et al. | 347/106 |

FOREIGN PATENT DOCUMENTS

| | | |
|---|---|---|
| 0212655A2 | 3/1987 | European Pat. Off. . |
| 0553760A1 | 8/1993 | European Pat. Off. . |
| 54-59936 | 5/1979 | Japan . |
| 61-118477 | 6/1986 | Japan . |
| 62-243890 | 10/1987 | Japan . |

*Primary Examiner*—Valerie Lund

*Attorney, Agent, or Firm*—Fitzpatrick, Cella, Harper & Scinto

[57] ABSTRACT

An ink jet printing method includes supplying at least two types of inks on a cloth such that the two types of inks overlap, wherein the cloth contains fibers which can be dyed with disperse dye, the two types of inks at least contain pigments, a compound for dispersing the pigments and an aqueous liquid medium, and the pigments are selected from a specific group of pigments.

24 Claims, 4 Drawing Sheets

INK JET TEXTILE PRINTING SYSTEM AND METHOD USING DISPERSE DYES

BACKGROUND OF THE INVENTION

1. Field of the Invention

The present invention relates to an ink jet printing system including a method of ink jet printing on a cloth with satisfactory saturation, a set of inks for use in the method, and an ink jet printing apparatus for use in the method, and to a printed article produced by the printing system.

2. Related Art

At present, textile printing is mainly performed by screen printing and roller printing. However, the foregoing methods are not suitable for manufacturing various products in a small quantity and difficult to follow the fashion quickly. Therefore, an electronic textile-printing system using no plate has been desired.

In order to meet the foregoing desire, a multiplicity of ink jet textile-printing systems have been disclosed from various industrial fields.

The ink jet textile-printing system must meet the following requirements:

(1) Realized colors must have sufficiently thick density.

(2) A high degree of exhaustion of pigment must be realized on a cloth and waste water must easily be treated after the washing process.

(3) Irregular bleeding due to color mixture must be restricted on the cloth.

(4) A large color-reproduction range must be realized.

(5) Production must always stably be performed.

(6) Clear color must be realized.

(7) Saturation must not deteriorate even in a case where colors in the same type are mixed as well as in a case where different colors are mixed with one another.

In order to meet the foregoing desires, there have been employed the following means: any of various additives is added to an ink; the quantity of ink ejection is adjusted; and the cloth is subjected to pre-treatment.

A textile-printing method using a disperse dye, for example, an ink jet textile-printing method for printing on a polyester cloth, has been disclosed in Japanese Patent Laid-Open No. 61-118477. The method uses a disperse dye, the sublimation temperature of which is 180° C. or higher. However, if textile-printing is performed by using an ink comprising a disperse dye having a high-saturation hue while paying attention to only the sublimation temperature, excellent color can be imparted with excellent saturation in a case where each ink is used individually in dyeing. However, some combinations of dyes, in the foregoing case, deteriorate the saturation and considerably vary the density, tone and the reproducibility after dyeing if dyeing is performed under the same conditions, thus resulting in that the foregoing requirements (1), (4), (5), (6) and (7) cannot simultaneously be satisfied. The foregoing method is unsatisfactory to perform various color reproductions.

In particular, the field of sportswear exemplified by swishing suits and ski wear involves a necessity of imparting clear colors. Therefore, it is an important factor to obtain a printed article while maintaining the saturation and realizing a wide color-reproduction range.

SUMMARY OF THE INVENTION

Accordingly, an object of the present invention is to overcome the problems experienced with the conventional ink jet textile-printing technology when a pattern is ink-jet-printed on a cloth mainly composed of fibers which can be dyed with a disperse dye. In particular, an object of the present invention is to provide an ink jet printing system and a printed article including an ink jet printing method, an ink set and an ink jet printing apparatus for use in the method, with which the saturation does not deteriorate and a printed article exhibiting significantly wide color-reproducible range can be obtained even if a disperse dye, the hue of which exhibits excellent saturation, is used, and from which a stable image can be obtained even if the dyeing conditions by means of heating are somewhat changed.

The foregoing objects can be achieved by the present invention arranged as follows.

That is, according to one aspect of the invention, there is provided an ink jet printing method of a type supplying at least two types of inks on a cloth by an ink jet recording method, the method at least comprising the steps of:

(a) applying the at least two types of inks onto the cloth in such a manner that the two types of inks overlap;

(b) heat-treating the cloth onto which the inks have been supplied; and (c) washing the heat-treated cloth, wherein the cloth is cloth containing fibers which can be dyed with disperse dye, the at least two types of inks at least contain dyes, a compound for dispersing the dyes and an aqueous liquid medium, and each of the inks contains at least one of dyes selected from a group consisting of C.I. Disperse Yellow 82, 100, 124, 184:1, 186, 199, C.I. Disperse Red 239, 240, 277, 362, C.I. Disperse Orange 118, C.I. Disperse Blue 354 and 365, a printed article printed by the method, and an ink jet printing apparatus for use in the method.

According to another aspect of the present invention, there is provided a printed article comprising a printing medium and at least two types of dyes dyed on the printing medium while being allowed to overlap, wherein the dyes are selected from a group consisting of C.I. Disperse Yellow 82, 100, 124, 184:1, 186, 199, C.I. Disperse Red 239, 240, 277, 362, C.I. Disperse Orange 118, C.I. Disperse Blue 354 and 365, and the printing medium comprises a cloth containing fibers which can be dyed with a disperse dye.

Other and further objects, features and advantages of the invention will be appear more fully from the following description.

DETAILED DESCRIPTION OF THE PREFERRED EMBODIMENTS

Figure 1:
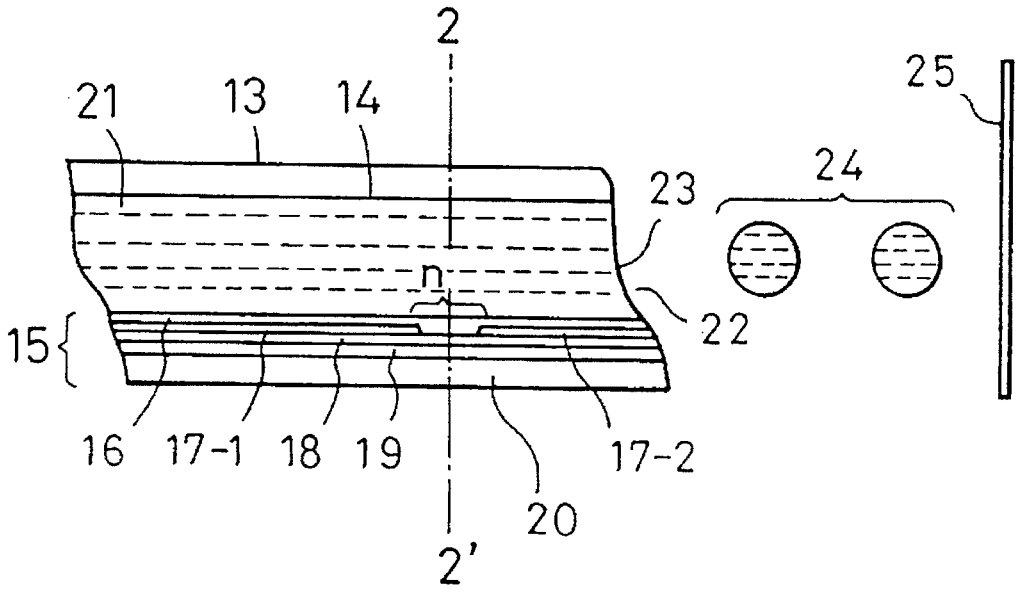
FIG. 1 is a vertical cross-sectional view which illustrates a head portion of an ink jet printing apparatus for use in the present invention.

The present invention will now be described.

Initially, cloth for use in the present invention will now be described.

The cloth for use in the present invention includes fibers which can be dyed with a disperse dye. It is preferable to use cloth including polyester, acetate or triacetate. In particular, it is preferable to use cloth including polyester. The fibers may be any of woven fabric, knitted fabric, or unwoven fabric.

The cloth preferably comprises fibers that can be dyed with the disperse dye. If the blending ratio is 30% or higher, preferably 50% or higher, blended woven or unwoven fabric of fibers, which can be dyed with a disperse dye, and another material, for example, rayon, cotton, polyurethane, acryl, nylon, wool or silk may be used in the present invention as the cloth to be printed.

The cloth to be printed for use in the present invention may be subjected to a conventional pre-treatment, if necessary. In particular, it is preferable that urea, a water-soluble polymer or a water-soluble metal salt be contained in the cloth by 0.01 to 20 wt %.

The water soluble polymer is exemplified by: a starchy substance such as corn or wheat; a cellulose-type substance such as carboxylic methyl cellulose, methyl cellulose or hydroxyethyl cellulose; a polysaccharide such as sodium alginate, gum Arabic, locust bean gum, tragacanth gum, guar gum or tamarind seed; or a known natural water-soluble polymer such as a protein substance exemplified by gelatin and casein, tannic substance and a lignin substance.

The synthetic polymer is exemplified by a known polyvinyl alcohol compound, a polyethylene oxide compound, an acrylic acid type water-soluble polymer and a maleic anhydride. Among these substances, it is preferable that the polysaccharide polymer or the cellulose type polymer be used.

The water-soluble metal salt is exemplified by a compound of a type forming a typical ion crystal, such as a halide of an alkali metal or that of an alkali earth metal and having a pH of 4 to 10. The alkali metal salt of the foregoing compound is exemplified by NaCl, $Na_2SO_4$, KCl and $CH_3COONa$. The alkali earth metal salt is exemplified by $CaCl_2$ and $MgCl_2$. Among the foregoing substances, it is preferable to use a salt of Na, K or Ca.

The dyes having significant hue and contained in the ink according to the present invention will now be described, the pigment being a characteristic of the present invention.

As the foregoing pigment, a disperse dye is used. A dye simply having excellent hue is insufficient for use in the present invention, and therefore the dyes, which can be used in the present invention, are extremely limited to meet the required dyeing characteristics and discharge characteristics.

Inks have been experientally manufactured, with the inks respectively containing various disperse dyes, and the inks were mixed on the foregoing cloth. As a result, it was found that the ink jet printing method involved deterioration in the saturation depending upon the combination of the dyes. In addition, the density and the color tone imparted by the pigment and the repetitive reproducibility realized under the same dyeing conditions vary considerably. The foregoing phenomenon becomes critical in a case where the dyeing process is performed by the HT steaming method or the thermosol method.

It has been known that, in a case where polyester cloth is, by immersion dyeing or the like, dyed with two types of disperse dyes in one immersion operation, the compatibility of the two types of the dyes changes the density of the dye. This is considered to be due to the structures (they are independent or bound) of the two types of the dyes in water ("Explanation of Dye Chemistry", Shikisen-sha). However, the foregoing problem is peculiarly prevalent in immersion dyeing. The foregoing problem has not been substantially discussed in conventional textile-printing.

However, textile printing by means of ink jet printing involves a critical difference caused from the combination of the dye in comparison to that experienced with the immersion dyeing process.

Although the reason for this has not been clarified, it can be considered that the difference occurring due to the combination of dyes becomes clearer in the method in which ink droplets are sequentially jetted than that taken place in the conventional method because the absolute supply quantity of dye is too small and the dot formation is performed. Research to overcome the foregoing problems has shown that use of certain limited dyes prevents the change in the density of the printed dye and the color tone due to the combination of dyes and deterioration in the saturation and stabilizes the reproducibility of colors of the dyed portions.

Accordingly, dyes that can be used are limited to the following dyes:

As the pigment in the ink, it is necessary to contain at least one of dyes selected from a group consisting of C.I. Disperse Yellow 82, 100, 124, 184:1, 186, 199, C.I. Disperse Red 239, 240, 277, 362, C.I. Disperse Orange 118, C.I. Disperse Blue 354 and 365. In particular, it is preferable to contain at least a dye selected from a group consisting of C.I. Disperse Yellow 82, 184:1, 186, 199, C.I. Disperse Red 239, 277, 362, C.I. Disperse Orange 118, C.I. Disperse Blue 354 and 365.

At least one of the foregoing dyes are contained in the ink according to the present invention. The total content with respect to the overall weight of the ink is 1 to 25 wt %, more preferably 1.5 to 20 wt %, most preferably 2 to 15 wt %.

The ink according to the present invention at least contains the foregoing dyes, a compound for dispersing the dyes and an aqueous liquid medium.

The compound for dispersing the dyes may be any of a so-called dispersant, a surface active agent and a resin.

As the dispersant or the surface active agent, an anion type agent or nonion type agent may be used. The anion type agent is exemplified by fatty acid salt, alkylsulfuric acid ester salt, alkylbenzene sulfuric acid salt, alkylnaphthalene sulfonic acid salt, dialkylsulfosuccinate, alkylphosphate acid ester salt, naphthalene sulfonic acid formalin condensate, polyoxyethylene alkylsulfuric acid ester salt and their substituted derivatives. The nonion type agent is exemplified by polyoxyethylene alkyl ether, polyoxyethylene alkylphenyl ether, polyoxyethylene fatty acid ester, sorbitan fatty acid ester, polyoxyethylene sorbitan fatty acid ester, polyoxyethylene alkylamine, glycerin fatty acid ester, oxyethylene oxypropylene block polymer and their substituted derivatives.

The resin dispersant is exemplified by a block copolymer, a random copolymer and a graft copolymer and their salts, with the block copolymer, random copolymer and graft copolymer being made of two or more monomers (at least one of the monomers is a hydrophilic monomer) selected from a group consisting of styrene and its derivative, vinyl naphthalene and its derivative, aliphatic alcohol ester of α, β-ethylene unsaturated carboxylic acid, acrylic acid and its derivative, maleic acid and its derivative, itaconic acid and its derivative, fumaric acid and its derivative, vinyl acetate, vinyl alcohol, vinyl pyrrolidone, and acrylamide and its derivative. It is preferable that the foregoing resins be alkali-soluble resin which can be dissolved in a water solution in which a base is dissolved.

The ink according to the present invention contains an aqueous liquid medium in such a manner that water, which is the essential component, is 10 to 93 wt % of the total weight of the ink, preferably 25 to 87 wt %, and more preferably 30 to 82 wt %.

It is preferable to contain an organic solvent in addition to water. The organic solvent is exemplified by: a ketone or ketoalcohol such as acetone or diacetone alcohol; an ether such as tetrahydrofuran or dioxane; an oxyethylene or oxypropylene additive polymer such as diethylene glycol, triethylene glycol, tetraethylene glycol, dipropylene glycol, tripropylene glycol, polyethylene glycol or polypropylene glycol; an alkylene glycol comprising an alkylene group containing 2 to 6 carbon atoms, such as ethylene glycol, propylene glycol, trimethylene glycol, butylene glycol, 1,2,6-hexanetriol or hexylene glycol; thiodiglycol; glycerin; a lower alkyl ether of polyhydroxy alcohol such as ethylene glycol monomethyl (or ethyl) ether, diethylene glycol monomethyl (or ethyl) ether or triethylene glycol monomethyl (or ethyl); a lower dialkyl ether of polyhydroxy alcohol such as triethylene glycol dimethyl (or ethyl) ether or tetraethylene glycol dimethyl (or ethyl) ether; or sulforan, N-methyl-2-pyrrolidone or 1,3-dimethyl-2-imidazolidinone.

The foregoing mediums may be used solely or in a mixed manner. The most preferred composition of the liquid medium is such that the solvent contains at least one hydroxy alcohol. Among the foregoing compositions, it is particularly preferred to use solely or a mixture of the thiodiglycol or the diethylene glycol.

The content of the water-soluble organic solvent is 5 to 60% of the overall weight of the ink, preferably 5 to 50%.

The thus-composed ink according to the present invention may contain any of various known viscosity adjusters, surface-tension adjusters, fluorescent brighteners and anti-foaming agents added thereto, if necessary. For example, any of the following agents may be added: a viscosity adjuster such as polyvinyl alcohol, cellulose or water-soluble resin; a surface-tension adjuster such as diethanol amine or triethanol amine; a pH adjuster using a buffering solution; and a mildewproofing agent.

In order to achieve another object other than the object of dispersing the dye, any of various dispersants and surface active agents and the like may be added as a component of the ink.

The ink according to the present invention can be manufactured by using the foregoing pigments, the compound for dispersing the pigments, the solvent, water and other additives by a known dispersing method and mixing method.

The ink jet printing method according to the present invention comprises the step of jetting an ink droplet to the cloth so as to form a color-mixed portion imparted by inks of two or more colors.

In this case, the total amount of each pigment allowed to stick to the color-mixed portion is 0.01 to 1 mg/cm$^2$, preferably 0.015 to 0.6 mg/cm$^2$, more preferably 0.02 to 0.4 mg/cm$^2$. The foregoing values can be obtained by measuring the quantity of the ink discharged and the concentration of the pigment present in the ink. If the amount of the pigment allowed to stick is less than 0.01 mg/cm$^2$, colors cannot be imparted at high densities. Therefore, the effect of the present invention cannot be obtained clearly. If it is larger than 1 mg/cm$^2$, the density, color reproducible range and the dyeing stability cannot significantly be improved.

The ink jet printing method may be any of the several methods. It is most effective to employ a method disclosed in, for example, Japanese Patent Laid-Open No. 54-59936, in which an ink, on which heat energy is acted, undergoes rapid volume change, and the operational force generated due to the state change causes the ink to be discharged through a nozzle, that is, it is effective to employ the bubble jet. printing method.

The reason for this is that, if a recording head having a plurality of nozzles is used in the foregoing method, the non-uniformity of the ink discharge speed among the nozzles can be prevented so that the ink discharge speeds are converged into a range from 5 to 20 m/sec, thereby realizing the most suitable state of penetration of the supplied droplet into the cloth when the ink containing the disperse dye collides with the cloth.

The present invention enables printing to be performed stably even if printing is continuously performed for a long time by the foregoing method without sticking of foreign materials onto a heater of the apparatus and disconnection of the wiring.

In order to obtain a satisfactory effect in the foregoing ink jet printing method, it is preferable that the discharged droplets range from 20 to 200 pl, the quantity of the supplied ink be 4 to 40 nl/mm$^2$, the drive frequency be 1.5 KHz or higher and the temperature of the head be 35° to 60° C.

The ink supplied onto the cloth as described above is only allowed to adhere to the cloth in the foregoing state. Therefore, a process for dyeing the pigment onto the fibers and a process for removing non-dyed pigments must be performed. The foregoing dyeing process and the pigment removing process may be performed by known methods.

It is preferable to employ a HT steaming method or a thermosol method as the dyeing method. If the HT steaming method is employed, it is preferable that the process be performed at 140° C. to 180° C. for 2 to 30 minutes, more preferably at 160° C. to 180° C. for 6 to 8 minutes. If the thermosol method is employed, it is preferable that the conditions be 160° C. to 210° C. for 10 seconds to 5 minutes, more preferably 180° C. to 210° C. for 20 seconds to 2 minutes.

The printed article is, if necessary, separated into sections having a desired size by cutting. The cut sections are subjected to sewing, bonding and welding processes and a process for obtaining a final product so that final products, for example, neckties or handkerchiefs, can be obtained.

A preferred apparatus for printing is exemplified by an apparatus arranged in such a manner that heat energy corresponding to a recording signal is applied to ink in a chamber of a recording head thereof and a droplet is generated by the heat energy. The foregoing apparatus will now be described.

An example of the structure of the head, which is the essential portion of the apparatus, will now be described with reference to FIGS. 1, 2 and 3.

A head 13 can be obtained by bonding a glass, ceramic or plastic plate having a groove 14 through which ink is allowed to flow and a heat generating head 15 (although a head is illustrated, the present invention is not limited to this) for use in an electrothermal recording process. The heat generating head 15 comprises a protective film 16 made of silicon oxide, aluminum electrodes 17-1 and 17-2, a heat-generative resistance layer 18 made of nichrome or the like, a heat storage layer 19 and a substrate 20 having good heat dissipating property, such as alumina. It is preferable that the conditions be such that the droplet discharged due to heat generated from nichrome or the like is 20 to 200 pl, the quantity of the supplied ink is 4 to 40 nl/mm$^2$, the drive frequency is 1.5 KHz or higher and the temperature of the head 15 is 35° to 60° C.

When the head is is use, supplied ink 21 in an ink passage reaches a discharge orifice (small aperture) 22 and forms a meniscus 23 due to pressure P.

When electric signals are supplied to the electrodes 17-1 and 17-2, a region of the heat generating head 15 represented by n rapidly generates heat. As a result, the ink 21, which is in contact with the region n, generates a bubble. The pressure of the bubble allows the meniscus 23 to project, causing the ink 21 to be discharged, thereby forming a recording droplet 24 by means of the orifice 22. The recording droplet 24 flies toward a cloth 25 for use in the present invention.

Figure 2:
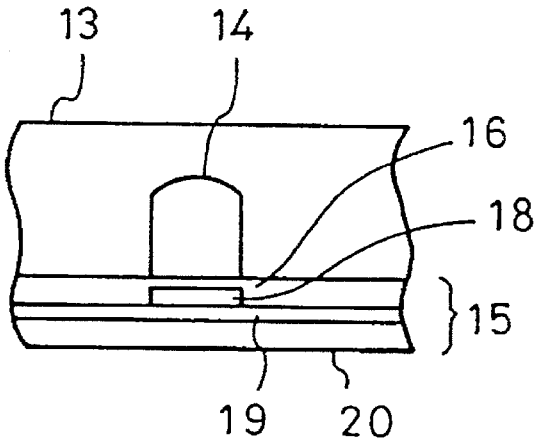
FIG. 2 is a lateral cross-sectional view which illustrates the head portion of the ink jet printing apparatus.
Figure 3:
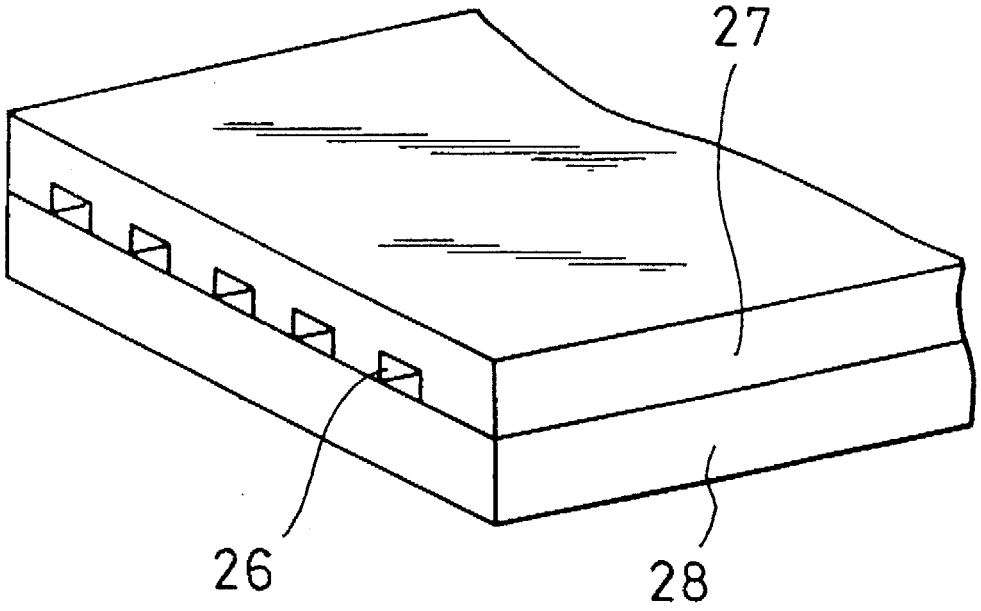
FIG. 3 is a perspective view which illustrates the outline of head of a multiple type comprising the head portion shown in FIG. 2.

FIG. 3 is an outline view which illustrates a multi-head comprising a plurality of the single head shown in FIG. 1 and which are arranged in an array. The multi-head is manufactured by bonding a glass plate 27 having a multi-groove 26 and a heat generating head 28 arranged similarly to that shown in FIG. 1. FIG. 1 is a cross-sectional view taken along an ink passage and showing the head 13. FIG. 2 is a cross-sectional view taken along line 2-2' shown in FIG. 1.

Figure 4:
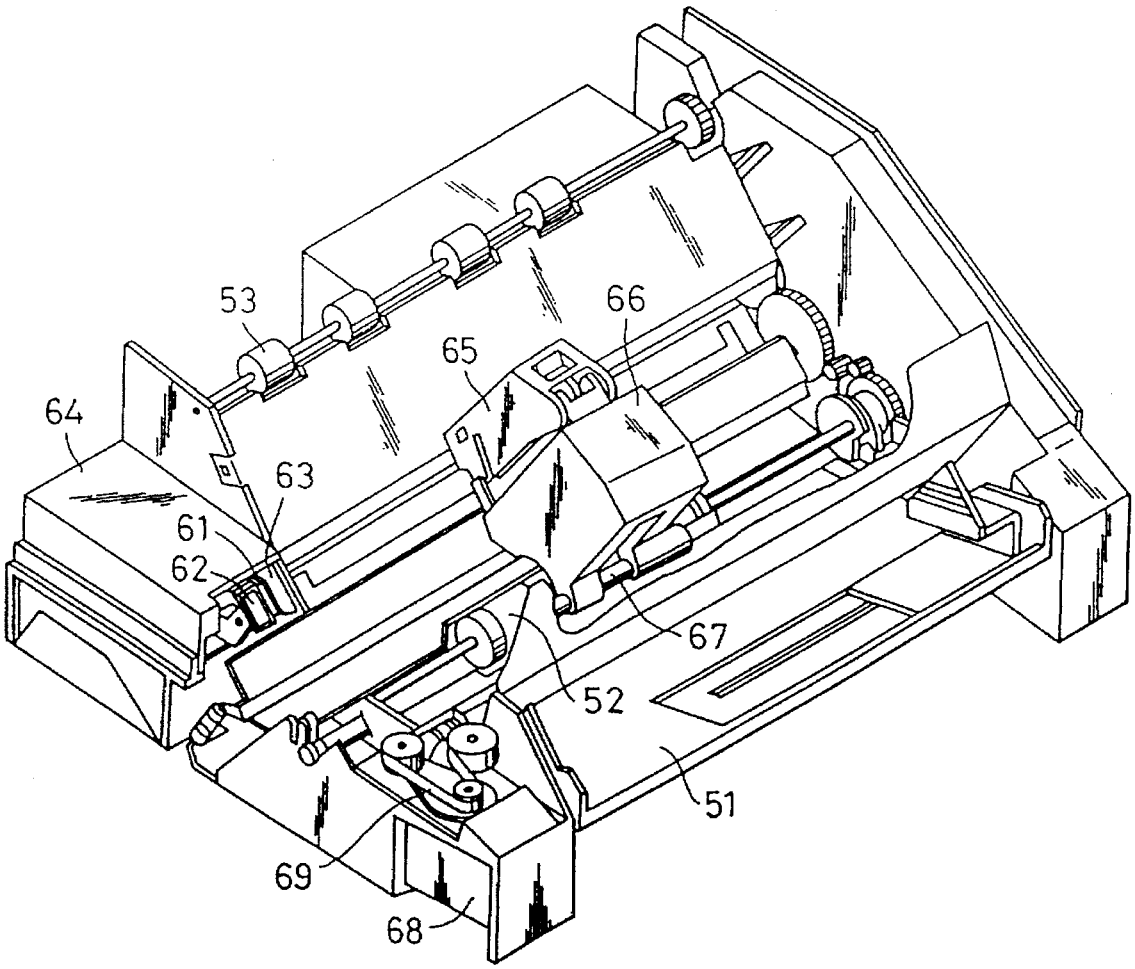
FIG. 4 is a perspective view which illustrates the ink jet printing apparatus.

FIG. 4 illustrates an example of an ink jet recording apparatus including a head of the foregoing type.

Referring to FIG. 4, reference numeral 61 represents a blade serving as a wiping member, an end of which is held by a blade holding member so that it is formed into a fixed end, thus forming a cantilever shape. The blade 61 is disposed adjacent to a recording region in which recording is performed by the recording head. In this embodiment, the blade 61 is held so as to project into a movement passage for the recording head. Reference numeral 62 represents a cap disposed at a home position adjacent to the blade 61, the cap 62 having a structure such that it moves in a direction perpendicular to the direction in which the recording head is moved so as to be brought into contact with a discharge port surface so that it performs capping. Reference numeral 63 represents an absorber disposed adjacent to the blade 61 and held so as to be allowed to project into the movement passage for the recording head similarly to the blade 61. The blade 61, the cap 62 and the absorber 63 form a discharge recovery portion 64 so that water and dust and the like are removed from the ink discharge port. Reference numeral 65 represents a recording head having a discharge energy generating means for performing recording by discharging ink to a cloth facing the discharge port. Reference numeral 66 represents a carriage, on which the recording head 65 is mounted, and which moves the recording head 65. The carriage 66 slidably engages a guide shaft 67, the carriage 66 having a portion connected (omitted from illustration) to a belt 69 which is moved by a motor 68. As a result, the carriage 66 is able to move along the guide shaft 67 so that the recording head 65 is able to move to the recording region and regions adjacent to the recording region.

Reference numeral 51 represents a cloth-supply portion for inserting the cloth, and 52 represents a cloth-conveyance roller which is rotated by a motor (omitted from illustration). As a result of the foregoing structure, the cloth is moved to a position at which it faces the discharge port of the recording head, the cloth being, as the recording operation proceeds, discharged to a cloth-discharge portion in which cloth-discharge rollers 53 are disposed.

In the foregoing structure, when the recording head 65 returns to the home position because, for example, the recording operation has been completed, the cap 62 in the head recovery portion 64 has been moved away from the moving passage for the recording head 65. On the other hand, the blade 61 projects into the moving passage. As a result, the discharge port of the recording head 65 is wiped. When the cap 62 is brought into contact with the discharge port of the recording head 65 to perform capping, the cap 62 is moved in such a manner that it projects into the moving passage for the recording head.

When the recording head 65 moves from the home position to a position at which the recording operation is commenced, the cap 62 and the blade 61 are at the same positions at which they are positioned when the wiping operation is performed. As a result, the discharge port of the recording head 65 is wiped also at the foregoing movement.

The movement of the recording head to the home position is performed in such a manner that it is, at predetermined intervals, moved to the home position adjacent to the recording region during a recording period in which the recording head is moved in the recording region, as well as performed when the recording period is completed and when the discharge recovery is performed. The foregoing movement causes the wiping operation to be performed.

Figure 5:
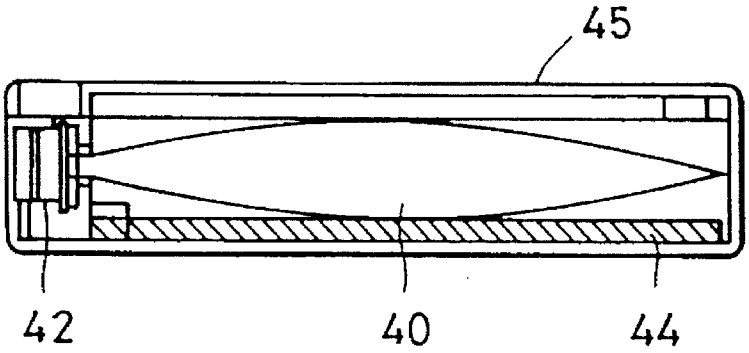
FIG. 5 is a vertical cross-sectional view which illustrates an ink cartridge for use with the present invention.

FIG. 5 is a view which illustrates an example of an ink cartridge accommodating the ink supplied to the head through an ink supply member, for example, a tube. Referring to FIG. 5, reference numeral 40 represents an ink accommodating portion, for example, an ink bag, accommodating the ink to be supplied and having, at the leading portion thereof, a rubber cap 42. By inserting a needle (omitted from illustration) into the cap 42, the ink in the ink bag 40 can be supplied to the head. Reference numeral 44 represents an absorber for receiving used ink. As the ink accommodation portion, it is preferable for the present invention that its surface in contact with the ink be made of a polyolefine, preferably polyethylene. As the ink jet recording apparatus for use in the present invention, there is no limitation to the structure of the head and the ink cartridge, which may be formed individually. A structure comprising the head and cartridge formed integrally may be preferably employed.

Figure 6:
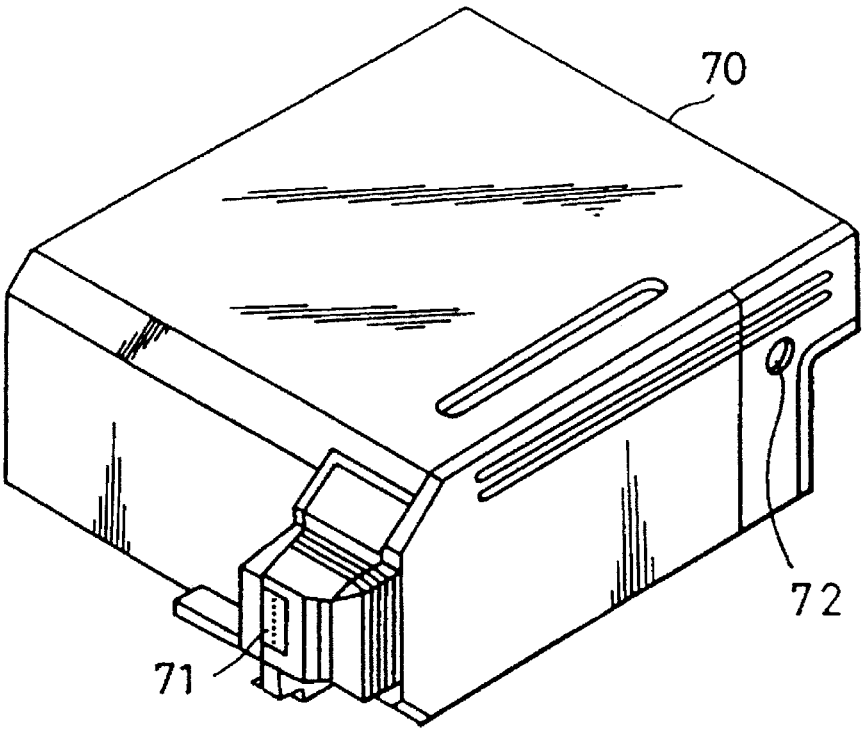
FIG. 6 is a perspective view which illustrates a recording unit for use with the present invention.

Referring to FIG. 6, reference numeral 70 represents a recording unit which accommodates the ink accommodating portion, for example, an ink absorber for accommodating the ink. The structure is so arranged that the ink in the ink absorber is discharged from a head portion 71 having a plurality of orifices. As the material for the ink absorber, it is preferable for the present invention to employ polyurethane. Reference numeral 72 represents an air communication port that establishes communication between the inside of the recording unit and the air. The recording unit 70 is used in place of the recording head shown in FIG. 4 is detachable from the carriage 66.

The present invention can be adapted to office use and preferably industrial use.

EXAMPLES

The present invention will now be described further in detail with reference to examples and comparative examples. In the description below, "%" means wt % and "parts" means parts by weight unless otherwise described.

Example 1

Preparation of Disperse Dye Fluids (I and II)

| | |
|---|---|
| Polyoxyethylene alkylether sodium sulfate | 5 parts |
| Ion-exchanged water | 75 parts |
| Diethylene glycol | 5 parts |

The foregoing components were mixed with one another, and for each disperse dye fluid 15 parts of one of the following disperse dyes were added,

| | |
|---|---|
| Disperse dye | C.I. Disperse Orange 118 (for disperse dye I)<br>C.I. Disperse Red 362 (for disperse dye II) |

and pre-mixing was performed for 30 minutes, and then a dispersion process was performed under the following conditions:

| | |
|---|---|
| Dispersing machine | Sand grinder (manufactured by Igarashi Machine) |
| Crushing medium | Zirconium beads having a diameter of 1 mm |
| Charge ratio of the crushing medium 50% (volume) | |
| Crushing duration | 3 hours |

Then, a centrifugal separation process was performed (at 12,000 RPM for 20 minutes), and the sample was filtered by Fluoropore Filter FP-250 (manufactured by Sumitomo Denko) to remove coarse particles, so that disperse dye fluids (I and II) were obtained.

Preparation of Inks (A and B)

| | |
|---|---|
| Disperse dye fluids (I or II) | 40 parts |
| Thiodiglycol | 24 parts |
| Diethylene glycol | 11 parts |
| Ion exchanged water | 25 parts |

All components were mixed with one another, and the mixed solution was adjusted to pH 5 to 7 by means of acetic acid, so that inks A and B were obtained.

A 100%-polyester woven fabric was previously immersed in a treatment liquid (10% urea, 2% alginic acid soda and 88% water), and the fabric was dehydrated at a dehydration ratio of 30%, and then it was dried.

The inks (A and B) were supplied to a Color Bubble Jet Printer BJC820 (trade name of Canon) to print the following patterns having a size 3×3 cm on the foregoing fabric.

| Pattern: | Ink | Density of Each Color Printing | Density (Total) |
|---|---|---|---|
| 1 | A, B | 50% for each color | 100% |
| 2 | A, B | 50% for each color | 200% |

Then, the colors on the fabric were fixed by steaming process at 160° C. for 6 to 8 minutes.

Then, the fabric was washed with a neutral detergent, and the color density and the color stability of the printed article were evaluated. As a result, the color stability in the color-mixed portion was significantly excellent relatively evaluated by means of the K/S value as shown in Table 1. Moreover, thick colors were imparted even in portions in each of which the printing density was 100%.

Example 2

Preparation of Disperse Dye Fluids (III and IV)

| | |
|---|---|
| Lignin sulfonic acid | 2 parts |
| Ion-exchanged water | 73 parts |
| Diethylene glycol | 5 parts |

The foregoing components were mixed with one another, and for each disperse dye fluid 10 parts of one of the following disperse dyes were added,

| | |
|---|---|
| Disperse dye | C.I. Disperse Blue 354 (for disperse dye III)<br>C.I. Disperse Yellow 82 (for disperse dye IV) |

and pre-mixing was performed for 30 minutes, and then a dispersion process was performed under the following conditions:

| | |
|---|---|
| Dispersing machine | Sand grinder (manufactured by Igarashi Machine) |
| Crushing medium | Glass beads having a diameter of 0.5 mm |
| Charge ratio of the crushing medium 50% (volume) | |
| Crushing duration | 3 hours |

Then, a centrifugal separation process was performed (at 12,000 RPM for 20 minutes), and the sample was filtered by Fluoropore Filter FP-250 (manufactured by Sumitomo Denko) to remove coarse particles, so that disperse dye fluids (III and IV) were obtained.

Preparation of Inks (C and D)

| | |
|---|---|
| Disperse dye fluids (III or IV) | 30 parts |
| Thiodiglycol | 25 parts |
| Tetraethylene glycol dimethyl ether | 5 parts |
| Ion exchanged water | 50 parts |

All components were mixed with one another, and the mixed solution was adjusted to pH 5 to 7 by means of acetic acid, so that inks C and D were obtained.

A similar pattern to that according to Example 1 was printed on the fabric used in Example 1 by using the thus-prepared inks (C and D). Then, the formed pattern was fixed at 200° C. for 40 to 50 seconds by thermosol treatment.

Then, the fabric was washed with a neutral detergent, and the color density and the color stability of the printed article were evaluated. As a result, the color stability in the color-mixed portion was significantly excellent relatively evaluated by means of the K/S value as shown in Table 1. Moreover, thick colors were imparted even in portions in each of which the printing density was 100%.

Example 3

Preparation of Disperse Dye Fluids (V and VI)

| | |
|---|---|
| β-naphthalene sulfonic acid formic aldehyde condensation | 20 parts |
| Ion-exchanged water | 50 parts |
| Diethylene glycol | 10 parts |

The foregoing components were mixed with one another, and for each disperse dye fluid 20 parts of one of the following disperse dyes were added,

| | |
|---|---|
| Disperse dye | C.I. Disperse Red 239 (for disperse dye V)<br>C.I. Disperse Red 277 (for disperse dye VI) |

and pre-mixing was performed for 30 minutes, and then a dispersion process was performed under the following conditions:

| | |
|---|---|
| Dispersing machine | Pearl Mill (manufactured by Ashizawa) |
| Crushing medium | Glass beads having a diameter of 1 mm |
| Charge ratio of the crushing medium 50% (volume) | |
| Discharge speed | 100 ml/min |

Then, a centrifugal separation process was performed (at 12,000 RPM for 20 minutes), and the sample was filtered by Fluoropore Filter FP-250 (manufactured by Sumitomo Denko) to remove coarse particles, so that disperse dye fluids (V and VI) were obtained.

Preparation of Inks (E and F)

| | |
|---|---|
| Disperse dye fluids (V or VI) | 50 parts |
| Thiodiglycol | 23 parts |
| Diethylene glycol | 5 parts |
| Isopropyl alcohol | 3 parts |
| Ion exchanged water | 19 parts |

All components were mixed with one another, and the mixed solution was adjusted to pH 5 to 7 by means of acetic acid, so that inks E and F were obtained.

A blended fabric of 70% polyester and 30% cotton was previously immersed in a treatment liquid (10% urea, 2% carboxylic methylcellulose and 88% water), and the fabric was dehydrated at a dehydration ratio of 30%, and then it was dried. A similar pattern to that according to Example 1 was printed on the fabric used in Example 1 by using the thus-prepared inks (E and F). Then, the formed pattern was fixed at 160° C. for 6 to 8 minutes by steam treatment.

Then, the fabric was washed with a neutral detergent, and the color density and the color stability of the printed article were evaluated. As a result, the color stability in the color-mixed portion was significantly excellent relatively evaluated by means of the K/S value as shown in Table 1. Moreover, thick colors were imparted even in portions in each of which the printing density was 100%.

Comparative Example 1

Preparation of Disperse Dye Fluids (VII and VIII)

| | |
|---|---|
| Polyoxyethylene alkylether sodium sulfate | 5 parts |
| Ion-exchanged water | 75 parts |
| Diethylene glycol | 5 parts |

The foregoing components were mixed with one another, and for each disperse dye fluid 15 parts of one of the following disperse dyes were added,

| | |
|---|---|
| Disperse dye | C.I. Disperse Orange 61 (for disperse dye VII)<br>C.I. Disperse Red 113 (for disperse dye VIII) |

and pre-mixing was performed for 30 minutes, and then a dispersion process was performed under the following conditions:

| | |
|---|---|
| Dispersing machine | Sand Grinder (manufactured by Igarashi Machine) |
| Crushing medium | Zirconium beads having a diameter of 1 mm |
| Charge ratio of the crushing medium 50% (volume) | |
| Crushing duration | 3 hours |

Then, a centrifugal separation process was performed (at 12,000 RPM for 20 minutes), and the sample was filtered by Fluoropore Filter FP-250 (manufactured by Sumitomo Denko) to remove coarse particles, so that disperse dye fluids (VII and VIII) were obtained.

Preparation of Inks (G and H)

| | |
|---|---|
| Disperse dye fluids (VII or VIII) | 24 parts |
| Thiodiglycol | 40 parts |
| Diethylene glycol | 11 parts |
| Ion exchanged water | 19 parts |

All components were mixed with one another, and the mixed solution was adjusted to pH 5 to 7 by means of acetic acid, so that inks G and H were obtained.

A similar pattern to that according to Example 1 was printed on the fabric used in Example 1 by using the thus-prepared inks (G and H). Then, the formed pattern was fixed at 160° C. for 6 to 8 minutes by steam treatment.

Then, the fabric was washed with a neutral detergent, and the color density and the color stability of the printed article were evaluated. As a result, the color stability in the color-mixed portion was inferior to Example 1 when relatively evaluated by means of the K/S value as shown in Table 1. What is worse, no color was imparted in portions in each of which the printing density was 100%.

Comparative Example 2

Preparation of Disperse Dye Fluid (IX)

| | |
|---|---|
| Polyoxyethylene alkylether sodium sulfate | 5 parts |
| Ion-exchanged water | 75 parts |
| Diethylene glycol | 5 parts |

The foregoing components were mixed with one another, and 15 parts of the following disperse dye was added,

| | |
|---|---|
| Disperse dye | C.I. Disperse Orange 30 (for disperse dye IX) |

and pre-mixing was performed for 30 minutes, and then a dispersion process was performed under the following conditions:

| | |
|---|---|
| Dispersing machine | Sand Grinder (manufactured by Igarashi Machine) |
| Crushing medium | Zirconium beads having a diameter of 1 mm |
| Charge ratio of the crushing medium 50% (volume) | |
| Crushing duration | 3 hours |

Then, a centrifugal separation process was performed (at 12,000 RPM for 20 minutes), and the sample was filtered by Fluoropore Filter FP-250 (manufactured by Sumitomo Denko) to remove coarse particles, so that disperse dye fluid (IX) was obtained.

Preparation of Ink (I)

| | |
|---|---|
| Disperse dye fluid (IX) | 40 parts |
| Thiodiglycol | 24 parts |
| Diethylene glycol | 11 parts |
| Ion exchanged water | 25 parts |

All components were mixed with one another, and the mixed solution was adjusted to pH 5 to 7 by means of acetic acid, so that ink I was obtained.

A similar pattern to that according to Example 1 was printed on the fabric used in Example 1 by using the thus-prepared ink (I) and the ink (B) according to Example 1. Then, the formed pattern was fixed at 160° C. for 6 to 8 minutes by steam treatment. Then, the fabric was washed with a neutral detergent, and the color density and the color stability of the printed article were evaluated. As a result, the color stability in the color-mixed portion was inferior to Example 1 when relatively evaluated by means of the K/S value as shown in Table 1. What is worse, no color was imparted in portions in each of which the printing density was 100%.

Comparative Example 3

Preparation of Disperse Dye Fluid (X)

| | |
|---|---|
| β-naphthalene sulfonic acid formic aldehyde condensation | 20 parts |
| Ion-exchanged water | 50 parts |
| Diethylene glycol | 10 parts |

The foregoing components were mixed with one another, and 20 parts of the following disperse dye was added,

| | |
|---|---|
| Disperse dye | C.I. Disperse Yellow 56 (for disperse dye X) |

and pre-mixing was performed for 30 minutes, and then a dispersion process was performed under the following conditions:

| | |
|---|---|
| Dispersing machine | Pearl mill (manufactured by Ashizawa) |
| Crushing medium | Glass beads having a diameter of 1 mm |
| Charge ratio of the crushing medium 50% (volume) | |
| Discharging speed | 100 ml/min |

Then, a centrifugal separation process was performed (at 12,000 RPM for 20 minutes), and the sample was filtered by Fluoropore Filter FP-250 (manufactured by Sumitomo Denko) to remove coarse particles, so that disperse dye fluid (X) was obtained.

Preparation of Ink (J)

| | |
|---|---|
| Disperse dye fluid (X) | 50 parts |
| Thiodiglycol | 23 parts |
| Diethylene glycol | 5 parts |
| Isopropyl alcohol | 3 parts |
| Ion exchanged water | 19 parts |

All components were mixed with one another, and the mixed solution was adjusted to pH 5 to 7 by means of acetic acid, so that ink J was obtained.

A similar pattern to that according to Example 1 was printed on the fabric used in Example 3 by using the thus-prepared ink (J) and the ink (F) according to Example 3. Then, the formed pattern was fixed at 160° C. for 6 to 8 minutes by steam treatment. Then, the fabric was washed with a neutral detergent, and the color density and the color stability of the printed article were evaluated. As a result, the color stability in the color-mixed portion was inferior to Example 1 when relatively evaluated by means of the K/S value as shown in Table 1. What is worse, no color was imparted in portions in each of which the printing density was 100%.

TABLE 1

| | Color Density in 100% area*1 | Color Stability*2 |
|---|---|---|
| Example 1 | 0 | ○ |
| Example 2 | ○ | ○ |
| Example 3 | ○ | ○ |
| Comparative Example 1 | x | x |
| Comparative Example 2 | x | x |
| Comparative Example 3 | x | Δ |

*1: The K/S value of bicolor mixture portions in which the printing density was 100% and 200% respectively was measured, and the 100%-portion and 200% portion were relatively evaluated so as to judge the color density in the 100% portion.
○: the K/S value of the 200%-portion was less than 1.5 times that of the 100%-portion (all 100% portions were able to impart dark colors).
x: the K/S value of the 200%-portion was 1.5 times or more that of the 100%-portion (no dark color was imparted in each 100% portion).
*2: The K/S value of each of the samples according to Examples 1 and 3 and Comparative Examples 1 and 3 was measured after each sample was subjected to the steaming process for 6 minutes and for 8 minutes to obtain the difference. The K/S value of samples according to Example 2 were each subjected to the thermosol treatment for 40 seconds and 50 seconds to obtain the difference.
○: The difference in the K/S value was 1 or less. The difference due to heating was small.
Δ: The difference in the K/S value was between 1 and 2. A somewhat difference took place due to heating.
x: The difference in the K/S value was 2 or more. A considerable difference took place due to heating.

$$K/S=(1-R)^2/2R$$

where R: Reflection factor of the maximum absorption wavelength.

As described above, according to the present invention, a high density and clear printed article exhibiting a wide color-reproduction range and stable producibility can be obtained.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded to the broadest interpretation so as to encompass all such modifications and equivalent structures and functions.

What is claimed is:

1. An ink jet printing method for imparting at least two types of inks, each containing a disperse dye, a compound for dispersing the dye and an aqueous liquid medium, onto a cloth dyeable with a disperse dye, the method comprising the steps of:

imparting the at least two types of inks onto the cloth such that the two types of inks overlap to form a mixed portion;

heat-treating the cloth onto which the inks have been imparted; and washing the heat-treated cloth, wherein the dyes in each of the at least two types of inks comprises at least one of dyes selected from a group consisting of C.I. Disperse Yellow 82, 100, 124, 184:1, 186, 199, C.I. Disperse Red 239, 240, 277, 362, C.I. Disperse Orange 118, C.I. Disperse Blue 354 and 365, and the total amount of dyes imparted onto the mixed portion is in a range of from 0.01 to 1 mg/cm$^2$.

2. An ink jet printing method according to claim 1, wherein the cloth comprise polyester fibers.

3. An ink jet printing method according to claim 1, wherein said heat treating step comprises a hot steam method or a thermosol method.

4. An ink jet printing method according to claim 1, wherein said ink imparting step comprises discharging the ink by using heat energy.

5. An ink jet printing method according to claim 4, wherein a discharge speed of the ink is 5 to 20 m/sec.

6. An ink jet printing method according to claim 1, further comprising a step of treating the cloth with a solution containing at least one material selected from the group consisting of urea, a water-soluble polymer and a water-soluble metal salt, prior to said ink imparting step.

7. An ink jet printing method according to claim 6, wherein the water-soluble polymer comprises a material selected from the group consisting of starch, carboxymethylcellulose, methylcellulose, hydroxyethylcellulose, sodium alginate, gum arabic, locust beam gum, tragacanth gum, guar gum, tamarind seed, gelatin, casein, tannic substance and lignin substance.

8. An ink jet printing method according to claim 6, wherein the water-soluble polymer comprises a material selected from the group consisting of polyvinyl alcohol, polyethylene oxide, acrylic acid type water-soluble polymer and maleic anhydride.

9. An ink jet printing method according to claim 6, wherein the water-soluble metal salt includes sodium chloride, sodium sulfate, potassium chloride, sodium acetate, calcium chloride and magnesium chloride.

10. An ink jet printing method according to claim 6, wherein the material is contained in the cloth in an amount of from 0.01 to 20% by weight.

11. An ink jet printing method according to claim 1, wherein said ink imparting step is effected using a recording head for discharging the inks, an ink cartridge having an ink storing portion for storing the inks, and an ink supply portion for supplying the inks from the ink cartridge to the recording head.

12. An ink jet printing method according to claim 11, wherein in said ink imparting step the recording head discharges ink droplets by causing heat energy to act on the inks.

13. An ink jet printing method according to claim 1, wherein the total amount of dyes imparted to the color-mixed portion is in a range of from 0.015 to 0.6 mg/cm$^2$.

14. An ink jet printing method according to claim 1, wherein the total amount of dyes imparted to the color-mixed portion is in a range of 0.02 to 0.4 mg/cm$^2$.

15. A printed article printed by an ink jet printing method for imparting at least two types of inks, each containing a disperse dye, a compound for dispersing the dye and an aqueous liquid medium, onto a cloth dyeable with a disperse dye, said method comprising the steps of:

imparting the at least two types of inks onto the cloth such that the two types of inks overlap to form a mixed portion;

heat-treating the cloth onto which the inks have been imparted; and washing the heat-treated cloth, wherein the dyes in each of the at least two types of inks comprises at least one of dyes selected from a group consisting of C.I. Disperse Yellow 82, 100, 124, 184:1, 186, 199, C.I. Disperse Red 239, 240, 277, 362, C.I. Disperse Orange 118, and C.I. Disperse Blue 354 and 365., and the total amount of dyes imparted onto the mixed portion is in a range of from 0.01 to 1 mg/cm$^2$.

16. A printed article printed by the ink jet printing method according to claim 9, further comprising the steps of separating said printed article into separate sections of a desired size by cutting.

17. A printed article according to claim 15, wherein the total amount of dyes imparted to the color-mixed portion is in a range of from 0.015 to 0.6 mg/cm$^2$.

18. A printed article according to claim 15, wherein the total amount of dyes imparted to the color-mixed portion is in a range of from 0.02 to 0.4 mg/cm$^2$.

19. A printed article comprising:

a printing medium comprising a cloth containing fibers which can be dyed with a disperse dye; and at least two types of dyes dyed on said printing medium while overlapping, wherein said dyes are selected from a group consisting of C.I. Disperse Yellow 82, 100, 124, 184:1, 186, 199, C.I. Disperse Red 239, 240, 277, 362, C.I. Disperse Orange 118, and C.I. Disperse Blue 354 and 365, and the total amount of overlapped dyes is in a range of from 0.01 to 1 mg/cm$^2$.

20. A printing article according to claim 12, wherein the printed article is separated into separate sections of a desired size by cutting.

21. A printed article according to claim 12, wherein said printing medium comprises a cloth containing polyester fibers.

22. A printed article according to claim 14, wherein the printed article is separated into separate sections of a desired size by cutting.

23. A printed article according to claim 19, wherein the total amount of overlapped dyes is in a range of from 0.015 to 0.6 mg/cm$^2$.

24. A printed article according to claim 19, wherein the total amount of overlapped dyes is in a range of from 0.02 to 0.4 mg/cm$^2$.

* * * * *

UNITED STATES PATENT AND TRADEMARK OFFICE

CERTIFICATE OF CORRECTION

PATENT NO. : 5,631,684

DATED : May 20, 1997

INVENTOR(S) : Aya TAKAIDE, et al.

It is certified that error appears in the above-identified patent and that said Letters Patent is hereby corrected as shown below:

COLUMN 1:

Lines 57 and 58, "swishing" should read --swimming--.

COLUMN 4:

Line 19, "Research" should begin a new paragraph.

COLUMN 12:

Line 19, "24 parts" should read --40 parts--;
Line 20, "40 parts" should read --24 parts--.

COLUMN 16:

Line 42, "claim 12," should read --claim 19,--;
Line 45, "claim 12," should read --claim 19,--;
Line 48, "claim 14," should read --claim 21,--.

Signed and Sealed this

Twentieth Day of January, 1998

*Attest:*

Bruce Lehman

BRUCE LEHMAN

*Attesting Officer*

*Commissioner of Patents and Trademarks*